US010370736B2

(12) United States Patent
Jeong et al.

(10) Patent No.: US 10,370,736 B2
(45) Date of Patent: Aug. 6, 2019

(54) ULTRAHIGH-STRENGTH STEEL FOR WELDING STRUCTURE WITH EXCELLENT TOUGHNESS IN WELDING HEAT-AFFECTED ZONES THEREOF, AND METHOD FOR MANUFACTURING SAME

(71) Applicant: POSCO, Pohang-si (KR)

(72) Inventors: Hong-Chul Jeong, Pohang-si (KR); Ho-Soo Kim, Pohang-si (KR)

(73) Assignee: POSCO, Pohang-si (KR)

( * ) Notice: Subject to any disclaimer, the term of this patent is extended or adjusted under 35 U.S.C. 154(b) by 399 days.

(21) Appl. No.: 15/104,020

(22) PCT Filed: Dec. 22, 2014

(86) PCT No.: PCT/KR2014/012626
§ 371 (c)(1),
(2) Date: Jun. 13, 2016

(87) PCT Pub. No.: WO2015/099373
PCT Pub. Date: Jul. 2, 2015

(65) Prior Publication Data

US 2017/0002435 A1 Jan. 5, 2017

(30) Foreign Application Priority Data

Dec. 24, 2013 (KR) ..... 10-2013-0163291

(51) Int. Cl.
*C22C 38/00* (2006.01)
*C21D 9/46* (2006.01)
(Continued)

(52) U.S. Cl.
CPC ..... *C21D 9/46* (2013.01); *C21D 8/0205* (2013.01); *C21D 8/0226* (2013.01); *C22C 38/00* (2013.01);
(Continued)

(58) Field of Classification Search
CPC ..... C22C 38/00; C21D 2211/002
(Continued)

(56) References Cited

U.S. PATENT DOCUMENTS 8,049,131 B2 * 11/2011 Hara ..... B23K 9/0253 219/73

FOREIGN PATENT DOCUMENTS

JP 1999140582 5/1999
JP 2005290554 10/2005
(Continued)

OTHER PUBLICATIONS

NPL: Machine translation of JP 2008202119 A, Sep. 2008 (Year: 2008).*

(Continued)

*Primary Examiner* — Jie Yang
(74) *Attorney, Agent, or Firm* — Cantor Colburn LLP

(57) ABSTRACT

Provided is a ultrahigh strength steel for a welded structure having superior toughness in a weld heat-affected zone (HAZ) comprising: by wt %, carbon (C): 0.05% to 0.15%, silicon (Si): 0.1% to 0.6%, manganese (Mn): 1.5% to 3.0%, nickel (Ni): 0.1% to 0.5%, molybdenum (Mo): 0.1% to 0.5%, chromium (Cr): 0.1% to 1.0%, copper (Cu): 0.1% to 0.4%, titanium (Ti): 0.005% to 0.1%, niobium (Nb): 0.01% to 0.03%, boron (B): 0.0003% to 0.004%, aluminum (Al): 0.005% to 0.1%, nitrogen (N): 0.001% to 0.006%, phosphorus (P): 0.015% or less, sulfur (S): 0.015% or less, iron (Fe) as a residual component thereof, and inevitable impurities.

6 Claims, 1 Drawing Sheet

(51) Int. Cl.

| | |
|---|---|
| ***C22C 38/50*** | (2006.01) |
| ***C22C 38/14*** | (2006.01) |
| ***C21D 8/02*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/54*** | (2006.01) |
| ***C22C 38/58*** | (2006.01) |

(52) U.S. Cl.
CPC ..... *C22C 38/001* (2013.01); *C22C 38/002* (2013.01); *C22C 38/02* (2013.01); *C22C 38/06* (2013.01); *C22C 38/14* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 2211/002* (2013.01); *C21D 2211/005* (2013.01)

(58) Field of Classification Search
USPC ..... 420/91
See application file for complete search history.

(56) References Cited

FOREIGN PATENT DOCUMENTS

| | | |
|---|---|---|
| JP | 2006291348 | 10/2006 |
| JP | 2008202119 | 9/2008 |
| KR | 20110062903 | 6/2011 |
| KR | 20120033011 | 4/2012 |
| KR | 20120071618 | 7/2012 |
| KR | 20120087611 | 8/2012 |
| KR | 20130127189 | 11/2013 |

OTHER PUBLICATIONS

Chinese Office Action—Chinese Application No. 201480070512.3 dated Feb. 27, 2017, citing JP 2008-202119, JP 11-140582 and KR10-2012-0087611.
International Search Report—PCT/KR2014/012626 dated Mar. 26, 2015.

* cited by examiner

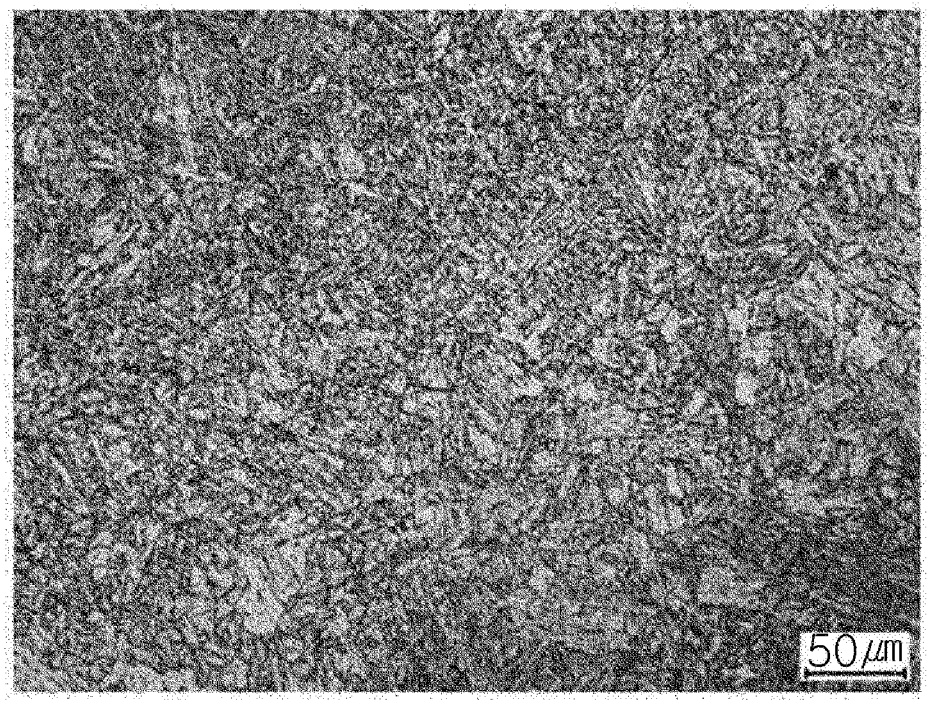
50μm

ULTRAHIGH-STRENGTH STEEL FOR WELDING STRUCTURE WITH EXCELLENT TOUGHNESS IN WELDING HEAT-AFFECTED ZONES THEREOF, AND METHOD FOR MANUFACTURING SAME

TECHNICAL FIELD

The present disclosure relates to structural steel used in welded structures, such as ships, buildings, bridges, or the like, and in detail, to ultrahigh strength steel for a welded structure having superior toughness in a weld heat-affected zone and a method of manufacturing the same.

BACKGROUND ART

Recently, as the height and size of buildings, structures, and the like has increased, steel used in such buildings and structures has increased in size as compared to the related art, and there has been demand for improved strength therein, and thus, the thickness of steel has gradually increased.

Although in order to manufacture large welded structures, higher levels of strength have been demanded in steel used therein, relatively low yield strength ratios are still demanded to improve shock resistance. In general, the microstructure of steel is commonly formed to have a soft phase like ferrite, and the yield strength ratio of steel is known to be reduced by implementing a structure in which a hard phase such as bainite, martensite, or the like is dispersed in a proper manner.

In order to weld high strength structural steel to manufacture welded structures, high efficiency welding is required. To this end, high efficiency welding having advantages in terms of construction cost reduction and welding procedure efficiency has commonly been used. However, in a case in which high efficiency welding is carried out, there is a problem in which crystal grains may grow or structures may coarsen during the welding process in a weld heat affected zone (positioned several millimeters from the interface between a welding metal and the steel in the direction of the steel) of a base metal, affected by heat, thus significantly reducing toughness.

In particular, since a coarse grain weld HAZ adjacent to a fusion boundary is heated to a temperature close to the melting point by welding heat input, crystal grains may grow. In addition, as an increase in the welding heat input slows down a cooling speed, coarse structures may be easily formed. Furthermore, since microstructures having difficulty in securing a sufficient degree of toughness, such as bainite, martensite-austenite, or the like, are formed in a cooling process, toughness in the weld HAZ in welding zones may easily be reduced.

In structural steel used in buildings, structures, or the like, not only high strength, but also a high degree of toughness is required in welding zones of steel for safety requirements. Therefore, in order to secure the stability of final welded structures, weld HAZ toughness needs to be secured, and in detail, microstructures of the HAZ, causing the deterioration of HAZ toughness, need to be controlled.

To this end, in Patent Document 1, technologies to secure toughness in welding zones through the miniaturization of ferrite using TiN precipitates are described.

In more detail, the content ratio of Ti/N is managed to form sufficient fine TiN precipitates, thus refining ferrite.

Thus, when 100 kJ/cm of heat input is applied, structural steel having around 200 J of impact toughness at 0° C. may be provided.

However, since weld HAZ toughness is commonly relatively low as compared to steel having 300 J of toughness, there is a limitation in securing the reliability of steel structures through the large heat input welding of thickened steel. In addition, there is a problem in which production costs increase, in that a heating process prior to hot rolling may need to be performed twice in order to secure fine TiN precipitates.

If a weld HAZ has the same level of toughness as that of steel, stable and high efficiency welding on large thick steel, such as buildings, structures, or the like, may be performed. Thus, there is demand for the development of steel for a welded structure in which stability and reliability are secured in such a manner that the weld HAZ has a degree of toughness equal to or higher than that of steel.

Patent Document 1: Japanese Patent Laid-Open Publication No. 1999-140582

DISCLOSURE

Technical Problem

An aspect of the present disclosure may provide ultrahigh strength steel for a welded structure having superior toughness in a weld heat-affected zone (HAZ) and a method of manufacturing the same.

Technical Solution

According to an aspect of the present disclosure, ultrahigh strength steel for a welded structure having superior toughness in a weld heat-affected zone (HAZ) may include, by wt %, carbon (C): 0.05% to 0.15%, silicon (Si): 0.1% to 0.6%, manganese (Mn): 1.5% to 3.0%, nickel (Ni): 0.1% to 0.5%, molybdenum (Mo): 0.1% to 0.5%, chromium (Cr): 0.1% to 1.0%, copper (Cu): 0.1% to 0.4%, titanium (Ti): 0.005% to 0.1%, niobium (Nb): 0.01% to 0.03%, boron (B): 0.0003% to 0.004%, aluminum (Al): 0.005% to 0.1%, nitrogen (N): 0.001% to 0.006%, phosphorus (P): 0.015% or less, sulfur (S): 0.015% or less, iron (Fe) as a residual component thereof, and inevitable impurities. In addition, the Ti and N component contents may satisfy Formula 1 below, the N and B component contents may satisfy Formula 2 below, and the Mn, Cr, Mo, Ni, and Nb component contents may satisfy Formula 3 below. Furthermore, the ultrahigh strength steel for a welded structure having superior toughness in a weld HAZ may include a microstructure, by area fraction, including acicular ferrite in an amount of 30% to 40% and bainite in an amount of 60% to 70%.

$$3.5 \le Ti/N \le 7.0 \quad \text{[Formula 1]}$$

$$1.5 \le N/B \le 4.0 \quad \text{[Formula 2]}$$

$$4.0 \le 2Mn+Cr+Mo+Ni+3Nb \le 7.0 \quad \text{[Formula 3]}$$

(In Formulas 1 to 3, respective component units are wt %.)

According to another aspect of the present disclosure, a method of manufacturing ultrahigh strength steel for a welded structure having superior toughness in a weld HAZ may include heating a slab satisfying the component composition to a temperature of 1100° C. to 1200° C.; manufacturing a hot rolled steel sheet through hot finish rolling of the heated slab at a temperature of 870° C. to 900° C.; and cooling the hot rolled steel sheet to a temperature of 420° C. to 450° C. at a cooling speed of 4° C./s to 10° C./s.

Advantageous Effects

As set forth above, according to exemplary embodiments in the present disclosure, provided is a ultrahigh strength steel for a welded structure that may have ultrahigh physical properties, and may secure properties of a large heat input weld HAZ.

In addition, the steel for a welded structure in an exemplary embodiment in the present disclosure may allow for large heat input welding in a state in which stability and reliability are secured, and may be properly used as large thick steel used in a building, a structure, or the like.

DESCRIPTION OF DRAWINGS

FIG. 1 is a result of observing a microstructure in a welding zone of steel for a welded structure, manufactured according to an exemplary embodiment in the present disclosure, through an optical microscope.

BEST MODE FOR INVENTION

Hereinafter, exemplary embodiments in the present disclosure will be described in detail with reference to the accompanying drawings. The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art. In the drawings, the shapes and dimensions of elements may be exaggerated for clarity, and the same reference numerals will be used throughout to designate the same or like elements.

The inventors of the present disclosure conducted a large amount of research into securing superior toughness in a welding zone in large thick steel sheets used in buildings, structures, or the like, which have become increasingly larger and require ultrahigh strength. Consequently, the inventors confirmed that steel having superior impact toughness in a weld heat-affected zone (HAZ) thereof may be provided by controlling a microstructure in the weld HAZ, and completed the present disclosure.

Hereinafter, according to an exemplary embodiment in the present disclosure, the ultrahigh strength steel for a welded structure having superior toughness in a weld HAZ will be described in detail.

According to an exemplary embodiment, the steel for a welded structure may include as a component, by wt %, carbon (C): 0.05% to 0.15%, silicon (Si): 0.1% to 0.6%, manganese (Mn): 1.5% to 3.0%, nickel (Ni): 0.1% to 0.5%, molybdenum (Mo): 0.1% to 0.5%, chromium (Cr): 0.1% to 1.0%, copper (Cu): 0.1% to 0.4%, titanium (Ti): 0.005% to 0.1%, niobium (Nb): 0.01% to 0.03%, boron (B): 0.0003% to 0.004%, aluminum (Al): 0.005% to 0.1%, nitrogen (N): 0.001% to 0.006%, phosphorus (P): 0.015% or less, sulfur (S): 0.015% or less, iron (Fe) as a residual component thereof, and inevitable impurities.

Hereinafter, a description of contents limiting the components of the steel for a welded structure as above will be described. In this case, a content unit of respective components thereof refers to wt % as long as there is no specific mention thereof.

C: 0.05% to 0.15%

C is an element suitable for increasing the strength of steel, and in detail, is the most significant element in determining a structure size and a fraction of martensite-austenite (M-A). If a C content is lower than 0.05%, a generation of an M-A structure is significantly limited, and thus required strength may not be sufficiently secured. On the other hand, if the C content is higher than 0.15%, weldability of a plate used as structural steel may deteriorate.

Si: 0.1% to 0.6%

Si is an element that may be used as a deoxidizer, and that may also increase strength. In detail, since Si improves stability of the M-A structure, Si may increase a fraction of the M-A structure even in a case in which a relatively low C content is included. If an Si content is lower than 0.1%, there may be a problem in which insufficient deoxidation may be achieved. Furthermore, if the Si content is higher than 0.6%, low-temperature toughness of the steel may be degraded, and weldability thereof may also deteriorate.

Mn: 1.5% to 3.0%

Mn is an element that may increase strength through solid solution strengthening, and may also play a role in facilitating the generation of the M-A structure. In detail, a MnS may be precipitated around a Ti oxide, and may affect a generation of acicular ferrite that may increase toughness in the weld HAZ. If an Mn content is lower than 1.5%, a sufficient fraction of the M-A structure may not be secured. On the other hand, if the Mn content is higher than 3.0%, a heterogeneous structure caused by Mn segregation may have a harmful impact on toughness in the weld HAZ, while an excessive increase in hardenability may lead to a significant decrease in toughness in the welding zone.

Ni: 0.1% to 0.5%

Ni is an element that may increase strength and toughness of the steel through solid solution strengthening. In order to obtain the effect, Ni of 0.1% or more need to be added. However, if an Ni content is higher than 0.5%, hardenability is increased, and thus toughness in the weld HAZ maybe degraded. In addition, as Ni is a high-priced element, economic efficiency may be significantly decreased.

Mo: 0.1% to 0.5%

Mo is an element significantly increasing hardenability and strength with the addition of only a small amount thereof. Furthermore, to this end, Mo of 0.1% or more needs to be added. However, since if an Mo content is higher than 0.5%, hardness in the welding zone may significantly increase, and toughness therein may be degraded, the Mo content may be limited to 0.5% or less.

Cr: 0.1% to 1.0%

Cr is an element improving strength by increasing hardenability. To this end, Cr of 0.1% or more needs to be added. However, since if a Cr content is higher than 1.0%, not only the steel, but also toughness in the welding zone may be degraded, the Cr content may be limited to 1.0% or less.

Cu: 0.1% to 0.4%

Cu is an element significantly reducing the degradation of steel toughness and improving the strength thereof. To this end, Cu of 0.1% or more needs to be added. However, since if a Cu content is higher than 0.4%, hardenability in the weld HAZ may increase, leading to a significant degradation in steel toughness and surface quality of a product, the Cu content may be limited to 0.4% or less.

Ti: 0.005% to 0.1%

Ti is combined with N to form a fine TiN precipitate, stable at high temperatures. When a steel slab is reheated, the TiN precipitate may inhibit grain growth, thereby significantly improving low-temperature toughness. To this end, Ti of 0.005% or more needs to be added. However, since if a Ti content is significantly high, there is a problem of nozzle clogging in continuous casting or a decrease in low-temperature toughness caused by crystallization in a central portion, the Ti content may be limited to 0.1% or less.

Nb: 0.01% to 0.03%

Nb may play a role in increasing toughness through grain refining in a structure, and may be precipitated to have a shape of NbC, NbCN, or NbN, thereby significantly increasing strength of a base metal and in the welding zone. To this end, Nb of 0.01% or more needs to be added. However, since if an Nb content is significantly high, a brittle crack may occur on a corner of the steel, and manufacturing costs may significantly rise, the Nb content may be limited to 0.03% or less.

B: 0.0003% to 0.004%

B may allow acicular ferrite having excellent toughness to be generated in a crystal grain, and may play a role in inhibiting grain growth by forming a BN precipitate. To this end, B of 0.0003% or more needs to be added. However, since if a B content is significantly high, hardenability and low-temperature toughness may be degraded, the B content may be limited to 0.004% or less.

Al: 0.005% to 0.1%

Al is an element allowing molten steel to be deoxidized at a relatively low price. To this end, Al of 0.005% or more may be added. On the other hand, if an Al content is higher than 0.1%, there may be a problem in which nozzle clogging may occur in continuous casting.

N: 0.001% to 0.006%

N is an element that is indispensable for allowing a precipitate, such as TiN, BN, or the like, to be formed, and may significantly inhibit grain growth in the weld HAZ in large heat input welding. To this end, N of 0.001% or more is needed. However, if an N content is higher than 0.006%, there is a problem in which toughness may be significantly degraded.

P: 0.015% or Less

P is an impure element causing center segregation in a rolling process and high-temperature cracking during welding. Therefore, a P content needs to be managed to be relatively low, and may be limited to 0.015% or less.

S: 0.015% or Less

Since if an S content is relatively high, a low melting point compound, such as FeS or the like, is formed, the S content may be managed to be significantly low. Therefore, the S content may be limited to 0.015% or less.

Among the components, Ti and N component contents satisfy Formula 1 below, N and B component contents satisfy Formula 2 below. Furthermore, component contents of Mn, Cr, Mo, Ni, and Nb satisfy Formula 3 below.

$$3.5 \leq Ti/N \leq 7.0 \quad \text{[Formula 1]}$$

$$1.5 \leq N/B \leq 4.0 \quad \text{[Formula 2]}$$

$$40.2 \leq 2Mn+Cr+Mo+Ni+3Nb \leq 7.0 \quad \text{[Formula 3]}$$

In an exemplary embodiment in the present disclosure, content ratios between Ti and N and between N and B may be controlled as below.

In terms of stoichiometry, the ratio of Ti and N (Ti/N) is 3.4. However, when a solubility product in an equilibrium state is calculated, in the case that the Ti/N ratio is higher than 3.4, the content of Ti dissolved at high temperatures decreases, thus improving high temperature stability of the TiN precipitate. However, since if solid N remaining after TiN is formed is present, aging properties may be facilitated, the remaining solid N is complexly precipitated as BN, thus further improving stability of the TiN precipitate. To this end, in an exemplary embodiment in the present disclosure, the Ti/N ratio and the N/B ratio need to be managed.

First, the Ti/N ratio may be within a range of 3.5 to 7.0.

If the Ti/N ratio is higher than 7.0, coarse TiN is crystallized among molten steel in a process of manufacturing steel. Therefore, a uniform distribution of TiN may not be obtained, and remaining solid Ti, not precipitated as TiN, may have a harmful impact on toughness in the welding zone, which may not be preferable. On the other hand, if the Ti/N ratio is lower than 3.5, an amount of solid N in the steel may significantly increase, thus having a harmful impact on toughness in the weld HAZ, which may not be preferable.

The N/B ratio may be within a range of 1.5 to 4.0.

If the N/B ratio is lower than 1.5, there is a problem in which an amount of a BN precipitate that may inhibit grain growth may be insufficient. On the other hand, if the N/B ratio is higher than 4.0, there may be a problem in which the effect reaches a limit thereof, and the amount of solid N significantly increases, and thus toughness in the weld HAZ may be degraded.

In addition, in an exemplary embodiment in the present disclosure, a composition relationship (2Mn+Cr+Mo+Ni+3Nb) between Mn, Cr, Mo, Ni, and Nb may be controlled. In this case, if a composition relationship formula thereof is lower than 4.0, strength in the weld HAZ is insufficient, and thus there is a difficulty in securing strength in a welded structure. On the other hand, if the composition relationship formula is higher than 7.0, a welding hardening property increases, thus having a harmful impact on impact toughness in the weld HAZ, which may not be preferable. Thus, in an exemplary embodiment in the present disclosure, in order to secure strength in the welding zone and optimum impact toughness in the weld HAZ, component contents of Mn, Cr, Mo, and Ni may be controlled as above.

According to an exemplary embodiment in the present disclosure, the steel having an advantageous alloy composition detailed above may obtain a sufficient effect only by including an alloying element within a content range detailed above. In order to further improve characteristics such as strength and toughness of the steel and toughness and weldability in the weld HAZ, alloying elements below within a proper range may be added. Only one element among the alloying elements below may be added, and two or more elements may be added if needed.

V: 0.005% to 0.2%

V may be dissolved at a lower temperature as compared to other microalloying elements, and may prevent strength from decreasing by being precipitated as VN in the weld HAZ. To this end, V of 0.005% or more needs to be added. However, since if a large amount of V, a relatively high-priced element, is added, economic efficiency may be decreased, and toughness may be degraded, a V content may be limited to 0.2% or less.

Ca and REM: 0.0005% to 0.005% and 0.005% to 0.05%, Respectively

Ca and REM may allow an oxide having excellent high-temperature stability to be formed to inhibit grain growth when being heated in the steel and to facilitate ferrite transformation in a cooling process, thus improving toughness in the weld HAZ. In addition, Ca may control a formation of coarse MnS during steel making. To this end, Ca of 0.0005% or more and REM of 0.005% or more may be added. However, if a Ca content is higher than 0.005% or an REM content is higher than 0.05%, a relatively large inclusion and a cluster may be generated to degrade cleanliness of the steel. One or more elements among Ce, La, Y, Hf, and the like, may be used as REM, and any one thereof may obtain the above-mentioned effect.

The residual component may include Fe and inevitable impurities.

In an exemplary embodiment in the present disclosure, the steel for a welded structure satisfying an entirety of the component composition detailed above may include acicular ferrite in an amount of 30% to 40% and bainite in an amount of 60% to 70%, as a microstructure.

In order to secure strength and toughness of the steel for a welded structure at the same time, the microstructure needs to be an acicular ferrite-bainite dual phase microstructure. In this case, if a fraction of acicular ferrite is higher than 40%, toughness in the weld HAZ may be secured, but there is a problem in securing strength. In addition, if a fraction of bainite is lower than 60%, there is a difficulty in securing strength. Therefore, the structural steel in an exemplary embodiment in the present disclosure may include proper fractions of acicular ferrite and bainite, respectively, as the microstructure. In detail, the case in which acicular ferrite in an amount of 30% to 40% and bainite in an amount of 60% to 70% are included may satisfy a required physical property, and in detail, a microstructure composition may include acicular ferrite in an amount of 35% and bainite in an amount of 65%.

In addition, according to an exemplary embodiment in the present disclosure, the steel for a welded structure may include the TiN precipitate having a size of 0.01 μm to 0.05 μm. Furthermore, the TiN precipitate may have a density of $1.0\times10^3/mm^2$ or more and may be dispersed at an interval of 50 μm or less.

Since if a size of the TiN precipitate is significantly small, most of the TiN precipitate may be easily redissolved in the base metal during high efficiency welding, an effect of inhibiting grain growth in the weld HAZ may be degraded. On the other hand, if the size thereof is significantly large, the TiN precipitate may behave in the same manner as a coarse nonmetallic inclusion, thereby affecting mechanical properties and reducing an effect of inhibiting grain growth. Therefore, in an exemplary embodiment in the present disclosure, the size of the TiN precipitate may be limited to 0.01 μm to 0.05 μm.

In addition, the TiN precipitates having the controlled size may be dispersed at a density of $1.0\times10^3/mm^2$ or more at an interval of 50 μm or less.

In the case of the TiN precipitate having a density of less than $1.0\times10^3/mm^2$, there is a difficulty in forming a fine grain in the weld HAZ after high efficiency welding. In detail, the TiN precipitates may be dispersed at a density of from $1.0\times10^3/mm^2$ to $1.0\times10^4/mm^2$.

In the case of the steel having the sufficient fine TiN precipitates in an exemplary embodiment, a size of an austenite crystal grain may be 200 μm or less in the large heat input welding. In addition, the steel may have the weld HAZ including, by area fraction, acicular ferrite in an amount of 30% to 40% and bainite in an amount of 60% to 70%, as the microstructure.

In the large heat input welding, if the size of an austenite crystal grain in the weld HAZ is greater than 200 μm, the weld HAZ having required toughness may not be obtained.

If a fraction of acicular ferrite as the microstructure is higher than 40%, impact toughness may increase, but securing sufficient strength may be difficult, which may not be preferable. On the other hand, if the fraction of acicular ferrite is lower than 30%, toughness in the weld HAZ may be negatively affected, which may not be preferable. In addition, if the fraction of bainite is lower than 60%, securing sufficient strength may be difficult. On the other hand, if the fraction of bainite is higher than 70%, there may be a difficulty in securing toughness in the weld HAZ.

The austenite crystal grain in the weld HAZ may be significantly affected by a size, the number, and dispersion of precipitates dispersed in the steel. In the case of the large heat input welding of the steel, a portion of the precipitates dispersed in the steel may be redissolved therein, thus reducing an effect of inhibiting growth of the austenite crystal grain.

Therefore, in order to obtain a fine austenite crystal grain in the weld HAZ and form the microstructure affecting toughness, in the large heat input welding, controlling the precipitates dispersed in the steel may be essential.

According to an exemplary embodiment, in the case of large heat input welding using the steel including the TiN precipitate under the conditions described above, the weld HAZ having superior toughness may be obtained as above, and the steel may have ultrahigh strength of 870 MPa or higher and excellent low temperature toughness, impact toughness of 47 J or higher at −20° C., and thus the steel may be applied as steel for a welded structure in a proper manner.

Hereinafter, according to another exemplary embodiment in the present disclosure, a method of manufacturing the steel for a welded structure will be described in detail.

In an exemplary embodiment, the method of manufacturing the steel for a welded structure may include reheating the steel slab satisfying an entirety of component compositions detailed above, manufacturing a hot rolled steel sheet through hot finish rolling of the steel slab, and cooling the hot rolled steel sheet.

First, the steel slab satisfying the entirety of the component composition may be reheated at a temperature of 1100° C. to 1200° C.

In general, a slab manufactured as a semi-finished product through steel making and continuous casting may need to go through a reheating process before hot rolling in order to inhibit dissolution of an alloy and growth of an austenite phase. In other words, an amount of solution of a trace alloying element, such as Ti, Nb, V, or the like, may be controlled, and a fine precipitate, such as TiN, may be used, thereby minimizing growth of the austenite crystal grain.

In this case, if a reheating temperature is lower than 1100° C., removing segregation of an alloy component in the slab may be difficult. On the other hand, if the reheating temperature is higher than 1200° C., the precipitate may decompose or grow, thus leading the austenite crystal grain to be significantly coarse.

According to a description above, the hot rolled steel sheet may be manufactured through finish rolling of the reheated steel slab at a temperature of 870° C. to 900° C.

In this case, rough rolling of the steel slab may be performed, and finish rolling may be performed. The rough rolling may be performed with a reduction rate of 5% to 15% per pass.

In addition, if a finish rolling temperature is lower than 870° C. or higher than 900° C., coarse bainite may be formed, which may not be preferable. In this case, the reduction rate may be within a range of 10% to 20%.

The manufactured hot rolled steel sheet may be cooled to a temperature of 420° C. to 450° C. at a cooling rate of 4° C./s to 10° C./s.

If the cooling rate is lower than 4° C./s, a structure may become coarse. On the other hand, if the cooling rate is greater than 10° C./s, there is a problem in which cooling to significantly low temperatures may lead to the formation of martensite.

In addition, if a cooling end temperature is lower than 420° C., martensite may be formed, which may not be preferable. On the other hand, if the cooling end temperature is higher than 450° C., the structure may become coarse, which may not be preferable.

When the described method is implemented, the steel for a welded structure needed in an exemplary embodiment in the present disclosure may be manufactured.

INDUSTRIAL APPLICABILITY

Hereinafter, the present disclosure will be described through exemplary embodiments in more detail. However, the following exemplary embodiments are provided to describe the present disclosure in more detail, but are not intended to limit the scope of the present disclosure. Here, the scope of the present disclosure is determined by aspects described in the claims and aspects able to be reasonably inferred therefrom.

Exemplary Embodiment

A steel slab having component composition and a component relation, illustrated in Tables 1 and 2 below, was reheated, hot rolled, and cooled in a method proposed in an exemplary embodiment in the present disclosure, so that respective hot rolled steel sheets were manufactured.

Respective hot rolled steel sheets manufactured according to the description above were heated on a welding condition corresponding to actual weld heat input, in detail at 1350° C., a maximum heating temperature; a weld thermal cycle having a cooling time of 40 seconds at 800° C. to 500° C. was applied; a surface of a test piece was ground; the hot rolled steel sheets were processed with the test piece to measure mechanical properties; physical properties were evaluated; and results were illustrated in Table 3 below.

In this case, a tensile test piece was manufactured based on the test piece of KS Standard No. 4 (KS B 0801), while a tensile test was conducted at a cross head speed of 10 mm/min.

In addition, an impact test piece was manufactured based on the test piece of KS Standard No. 3 (KS B 0809), while an impact test was evaluated at −20° C. through a Charpy impact test.

Furthermore, the size and the number of the precipitates, having a significant impact on toughness in the weld HAZ, and observation of the microstructure were measured through a point counting method using an optical microscope and an electron microscope, and the results are illustrated in Table 3. In this case, a surface to be tested was evaluated based on 100 $mm^2$.

TABLE 1

| Classification | Component Composition (wt %) | | | | | | | | | | | | | | |
|---|---|---|---|---|---|---|---|---|---|---|---|---|---|---|---|
| | C | Si | Mn | P | S | Ni | Mo | Cu | Cr | Ti | B* | Al | Nb | V | N* |
| Inventive Example 1 | 0.06 | 0.2 | 2.8 | 0.006 | 0.002 | 0.5 | 0.2 | 0.1 | 0.4 | 0.02 | 10 | 0.03 | 0.03 | — | 33 |
| Inventive Example 2 | 0.05 | 0.3 | 2.5 | 0.005 | 0.002 | 0.4 | 0.1 | 0.2 | 0.5 | 0.02 | 15 | 0.02 | 0.01 | 0.01 | 35 |
| Inventive Example 3 | 0.07 | 0.2 | 2.7 | 0.005 | 0.003 | 0.3 | 0.1 | 0.2 | 0.4 | 0.03 | 16 | 0.02 | 0.02 | — | 44 |
| Inventive Example 4 | 0.08 | 0.2 | 1.9 | 0.007 | 0.003 | 0.5 | 0.3 | 0.3 | 0.4 | 0.02 | 20 | 0.03 | 0.01 | — | 32 |
| Inventive Example 5 | 0.05 | 0.4 | 2.3 | 0.006 | 0.002 | 0.3 | 0.1 | 0.1 | 0.4 | 0.03 | 23 | 0.03 | 0.01 | — | 50 |
| Comparative Example 1 | 0.08 | 0.2 | 2.8 | 0.005 | 0.003 | 1.0 | — | — | 0.06 | 0.001 | — | — | — | — | 45 |
| Comparative Example 2 | 0.05 | 0.2 | 1.5 | 0.008 | 0.004 | 0.1 | 0.1 | 0.1 | 0.1 | — | 26 | 0.03 | 0.02 | — | 74 |
| Comparative Example 3 | 0.08 | 0.3 | 2.7 | 0.010 | 0.003 | 1.4 | 0.5 | 0.04 | 0.3 | 0.04 | — | 0.01 | 0.01 | — | 12 |
| Comparative Example 4 | 0.06 | 0.3 | 2.9 | 0.008 | 0.003 | 0.8 | 0.4 | 0.2 | 0.2 | 0.02 | 32 | 0.01 | 0.03 | — | 30 |
| Comparative Example 5 | 0.078 | 0.6 | 2.5 | 0.012 | 0.005 | 1.3 | 0.7 | 0.3 | 0.5 | 0.02 | 42 | 0.03 | — | 0.01 | 90 |

(In Table 1 above, a unit of B* and N* is 'ppm'.)

TABLE 2

| Classification | Composition Ratio of Alloying Element | | |
|---|---|---|---|
| | Ti/N | N/B | 2Mn + Cr + Mo + Ni + 3Nb |
| Inventive Example 1 | 6.1 | 3.3 | 6.8 |
| Inventive Example 2 | 5.7 | 2.3 | 6.0 |
| Inventive Example 3 | 6.8 | 2.8 | 6.3 |
| Inventive Example 4 | 6.3 | 1.6 | 5.0 |
| Inventive Example 5 | 6.0 | 2.2 | 5.4 |
| Comparative Example 1 | 0.2 | — | 6.6 |
| Comparative Example 2 | — | 2.8 | 3.4 |
| Comparative Example 3 | 33.3 | — | 7.6 |

TABLE 2-continued

| Classification | Composition Ratio of Alloying Element | | |
|---|---|---|---|
| | Ti/N | N/B | 2Mn + Cr + Mo + Ni + 3Nb |
| Comparative Example 4 | 6.7 | 0.9 | 7.3 |
| Comparative Example 5 | 2.2 | 2.1 | 7.5 |

TABLE 3

| Classification | Fraction of Microstructure | | TiN Precipitate | | Mechanical Properties | |
|---|---|---|---|---|---|---|
| | AF | B | Quantity (No./mm$^2$) | Average Size (μm) | Tensile Strength (MPa) | Impact Toughness ($vE_{-20°C}$ (J)) |
| Inventive Example 1 | 32 | 68 | $2.1 \times 10^4$ | 0.01 | 910 | 194 |
| Inventive Example 2 | 34 | 66 | $2.2 \times 10^4$ | 0.01 | 925 | 223 |
| Inventive Example 3 | 35 | 65 | $2.3 \times 10^4$ | 0.01 | 910 | 198 |
| Inventive Example 4 | 34 | 66 | $2.3 \times 10^4$ | 0.01 | 932 | 283 |
| Inventive Example 5 | 38 | 62 | $2.5 \times 10^4$ | 0.01 | 916 | 215 |
| Comparative Example 1 | 48 | 52 | $1.2 \times 10^2$ | 0.15 | 712 | 34 |
| Comparative Example 2 | 45 | 55 | $1.3 \times 10^2$ | 0.32 | 684 | 36 |
| Comparative Example 3 | 18 | 82 | $1.3 \times 10^2$ | 0.20 | 954 | 35 |
| Comparative Example 4 | 12 | 88 | $1.2 \times 10^2$ | 0.39 | 993 | 22 |
| Comparative Example 5 | 7 | 93 | $1.5 \times 10^2$ | 0.20 | 981 | 18 |

(In Table 3 above, AF refers to acicular ferrite, and B refers to bainite.)

As illustrated in Table 3 above, a weld HAZ of a steel (Inventive Examples 1 to 5) manufactured by satisfying component composition and a component relationship, proposed in an exemplary embodiment in the present disclosure, secured an entirety of superior strength and impact toughness, as the microstructure thereof may include acicular ferrite in an amount of 30% or more and bainite in an amount of 60% or more, and a sufficient amount of TiN precipitates are formed.

On the other hand, Comparative Examples 1 to 5 not satisfying the component composition and the component relation of an alloy did not include a sufficient number of the TiN precipitates in an entirety of cases, and the fraction of acicular ferrite of higher than 40% or lower than 30% was secured. Therefore, it can be confirmed that one or more physical properties between strength and impact toughness is inferior.

FIG. 1 is a result of observing the microstructure in a welding zone of Inventive Example 3. In addition, it can be confirmed that the microstructure mainly includes acicular ferrite and bainite (lower bainite).

The invention claimed is:

1. A steel sheet for a welded structure having superior toughness in a weld heat-affected zone (HAZ), the steel sheet comprising:

by wt %, carbon (C): 0.05% to 0.15%, silicon (Si): 0.1% to 0.6%, manganese (Mn): 1.5% to 3.0%, nickel (Ni): 0.1% to 0.5%, molybdenum (Mo): 0.1% to 0.5%, chromium (Cr): 0.1% to 1.0%, copper (Cu): 0.1% to 0.4%, titanium (Ti): 0.005% to 0.1%, niobium (Nb): 0.01% to 0.03%, boron (B): 0.0003% to 0.004%, aluminum (Al): 0.005% to 0.1%, nitrogen (N): 0.001% to 0.006%, phosphorus (P): 0.015% or less, sulfur (S): 0.015% or less, iron (Fe) as a residual component thereof, and inevitable impurities, wherein the Ti and N component contents satisfy Formula 1 below, the N and B component contents satisfy Formula 2 below, and the Mn, Cr, Mo, Ni, and Nb component contents satisfy Formula 3 below; and wherein the steel sheet comprises: a microstructure including, by area fraction, acicular ferrite in an amount of 30% to 40% and bainite in an amount of 60% to 70%, and the microstructure comprises: TiN precipitates having a size of 0.01 μm to 0.05 μm and a density of $1.0 \times 10^3$/mm$^2$ or more, and being dispersed at an interval of 50 μm or less, $$3.5 \le Ti/N \le 7.0 \quad \text{[Formula 1]}$$

$$1.5 \le N/B \le 4.0 \quad \text{[Formula 2]}$$

$$4.0 \le 2Mn+Cr+Mo+Ni+3Nb \le 7.0 \quad \text{[Formula 3]}$$

wherein in the Formulas 1 to 3, respective component units are wt %.

2. The steel sheet of claim 1, wherein the steel sheet further comprises, by wt %, one or more elements among vanadium (V): 0.005% to 0.2%, calcium (Ca): 0.0005% to 0.005%, and rare earth elements (REM): 0.005% to 0.05%.

3. The steel sheet of claim 1, further comprising: a weld HAZ formed in the steel sheet, wherein the weld HAZ comprises: a microstructure including, by area fraction, acicular ferrite in an amount of 30% to 40% and bainite in an amount of 60% to 70%, and an austenite crystal grain having a size of less than 200 μm.

4. A method of manufacturing a steel sheet for a welded structure having a weld heat-affected zone (HAZ), the method comprising:

preparing a slab comprising, by wt %, carbon (C): 0.05% to 0.15%, silicon (Si): 0.1% to 0.6%, manganese (Mn): 1.5% to 3.0%, nickel (Ni): 0.1% to 0.5%, molybdenum (Mo): 0.1% to 0.5%, chromium (Cr): 0.1% to 1.0%, copper (Cu): 0.1% to 0.4%, titanium (Ti): 0.005% to 0.1%, niobium (Nb): 0.01% to 0.03%, boron (B): 0.0003% to 0.004%, aluminum (Al): 0.005% to 0.1%, nitrogen (N): 0.001% to 0.006%, phosphorus (P): 0.015% or less, sulfur (S): 0.015% or less, iron (Fe) as a residual component thereof, and inevitable impurities, wherein the Ti and N component contents satisfy Formula 1 below, the N and B component contents satisfy Formula 2 below, and the Mn, Cr, Mo, Ni, and Nb component contents satisfy Formula 3 below;

heating the slab to a temperature of 1100° C. to 1200° C.;

hot finish rolling the heated slab at a temperature of 870° C. to 900° C. to form a hot finish rolled steel sheet; and cooling the hot finish rolled steel sheet to a temperature of 420° C. to 450° C. at a cooling speed of 4° C./s to 10° C./s to form a hot rolled steel sheet, wherein the hot-rolled steel sheet has a microstructure including, by area fraction, acicular ferrite in an amount of 30% to 40% and bainite in an amount of 60% to 70%, and the microstructure further comprises TiN precipitates having a size of 0.01 μm to 0.05 μm and a density of $1.0 \times 10^3$/mm$^2$ or more, and being dispersed at an interval of 50 μm or less, $$3.5 \le Ti/N \le 7.0 \quad \text{[Formula 1]}$$

$$1.5 \le N/B \le 4.0 \quad \text{[Formula 2]}$$

$$4.0 \le 2Mn+Cr+Mo+Ni+3Nb \le 7.0 \quad \text{[Formula 3]}.$$

5. The method of claim 4, wherein the slab further comprises, by wt %, one or more elements among V vanadium (V): 0.005% to 0.2%, calcium (Ca): 0.0005% to 0.005%, and rare earth elements (REM): 0.005% to 0.05%.

6. The method of claim 4, further comprising; forming a weld HAZ by welding the hot-rolled steel sheet, wherein the weld HAZ has a microstructure including, by area fraction, acicular ferrite in an amount of 30% to 40% and bainite in an amount of 60% to 70%, as a microstructure, and an austenite crystal grain having a size of less than 200 μm.

* * * * *